United States Patent [19]

Hoech

[11] 4,122,529

[45] Oct. 24, 1978

[54] METHOD AND APPARATUS FOR PROVIDING A CIRCUIT WITH A SMOOTH TRANSFER FUNCTION

[75] Inventor: Gary F. Hoech, Cedar Rapids, Iowa

[73] Assignee: Rockwell International Corporation, Dallas, Tex.

[21] Appl. No.: 818,380

[22] Filed: Jul. 25, 1977

[51] Int. Cl.[2] ..... G06G 7/28

[52] U.S. Cl. ..... 364/852; 307/229; 328/143; 343/12 A; 364/433; 364/573; 364/553

[58] Field of Search ..... 364/852, 433, 572, 573, 364/825, 828, 854, 553, 857; 343/12 A; 340/27 R, 27 NA; 244/177, 180, 181, 182; 307/229, 230; 328/142, 143

[56] References Cited

U.S. PATENT DOCUMENTS

| | | | |
|---|---|---|---|
| 3,560,726 | 2/1971 | Platt | 307/229 X |
| 3,560,727 | 2/1971 | Schussler | 307/229 X |
| 3,622,770 | 11/1971 | Edelson | 307/229 X |
| 3,644,836 | 2/1972 | Johnson | 307/229 X |
| 3,686,478 | 8/1972 | Goldberg et al. | 307/229 X |
| 3,974,365 | 8/1976 | Johnson | 340/27 R |

*Primary Examiner*—Joseph F. Ruggiero
*Attorney, Agent, or Firm*—H. Frederick Hamann; Richard A. Bachand

[57] ABSTRACT

A circuit for generating a smooth signal for use in linearizing an ARINC specified radio altimeter signal, includes an operational amplifier circuit having a piecewise linear transfer function. A time varying periodic signal is added to the radio altimeter signal at the input of the amplifier circuit, and the signal thus produced is filtered to thereby generate a smooth, linear representation of the altimeter signal. In one embodiment, the smoothed signal is differentiated to generate a signal representing the rate of change of the smoothed, linear signal, or altitude.

13 Claims, 4 Drawing Figures

METHOD AND APPARATUS FOR PROVIDING A CIRCUIT WITH A SMOOTH TRANSFER FUNCTION

BACKGROUND OF THE INVENTION

1. Field of the Invention

This invention relates in general to electrical circuits which provide smoothly varying non-linear transfer functions, and in particular to circuits for use in producing a linear, differentiatable waveform from a waveform having a logarithmically varying portion.

2. Description of the Prior Art

In many applications, it is desirable to transform a signal or waveform from one scale to another. In some cases, for instance, it is desirable to produce a linear signal from a signal which varies logarithmically. One such application, for example, involves aircraft radio altimeter signal processing. As is well known, radio altimeters are designed in accordance with ARINC specifications to produce an output signal which varies linearly over the lower portion of the altitude range and logarithmically over the upper portion. When the signal is applied to a cockpit indicator, the linear portion is displayed over a large region of an indicator dial, and represents lower altitudes where precision is particularly important. The logarithmically varying portion, on the other hand, is compressed into a smaller region of the indicator dial, and indicates higher altitudes at which precise accuracy is not of such importance.

It is sometimes desirable to develop a linear altitude signal from the normal radio altimeter signal just described. For instance, in automatic flight control systems in which certain aircraft control surfaces are controlled automatically in response to various air data and sensor signals, it may be desirable to have a linear altitude signal over a range of radio altimeter indications of interest.

One prior art system to obtain such linear signal waveform is shown in U.S. Pat. No. 3,974,365. This system produces a linear signal representation of the signal having a logarithmic section, with less than five percent error. This circuit represents one method for linearizing data, which is especially useful to enable differentiation of the signal to obtain a signal indicative of the rate of change of altitude, a parameter which is also important in automatic flight control systems and the like.

In many scale transforming circuits, however, the transfer function of the circuit used to derive the linear signal is approximated by a number of segments. At the so-called "breakpoints" or regions at which two adjacent segments join, a sharp transition may occur. In applications where the approximated signal is differentiated, such as in derivation of a rate of altitude change signal from an altitude signal, differentiation at such "breakpoints" often introduces large errors in the differentiated signal. Consequently, it is desirable that the signal to be differentiated be as smooth as possible over its range of interest, and especially at the "breakpoint" regions.

The present invention, in general, is intended for use in such scale conversion, and in particular, is directed to linearizing a radio altimeter signal which may vary logarithmically over a portion of the altitude range of interest. The circuit in accordance with the invention can be used in combination with, or in some instances to replace entirely, the system of the aforementioned prior art patents.

SUMMARY OF THE INVENTION

In light of the above, therefore, it is an object of the invention to provide a method and apparatus for smoothly rescaling a signal or waveform.

It is another object of the invention to provide a circuit for linearizing a waveform having a nonlinear portion.

It is another object of the invention to provide a circuit for producing a signal or waveform which varies linearly from a signal which has a logarithmically varying portion.

It is another object of the invention to provide means for generating a signal which varies linearly with variations in an independent variable from a signal which, over a part of its range of variation, varies logarithmically with variations in the independent variable.

It is yet another object of the invention to provide a circuit for use in conjunction with an aircraft radio altimeter to produce a linear output function or signal suitable for accurate differentiation to obtain an accurate altitude rate of change signal.

It is still another object of the invention to provide a method for linearizing a signal which varies over at least a portion of its range in accordance with a logarithmic function.

It is still another object of the invention to provide a signal linearizing circuit which is of relatively simple construction in comparison to linearizing circuits heretofore advanced.

It is another object of the invention to provide a smoothing circuit for reducing errors produced at the intersections or breakpoints of a segmented approximating transfer function.

These and other objects, features, and advantages will become apparent to those skilled in the art from the following detailed description when read in conjunction with the accompanying drawing and appended claims.

The invention, in its broad aspect, presents a circuit which provides a transfer function that accurately approximates a desired smooth transfer function. The circuit includes means for generating a periodic signal and means for combining the periodic signal with the input signal. Also included are means for transforming the combined input and periodic signals, using a transfer function which is a segmented approximation of the desired smooth transfer function. Finally, means are included for filtering the periodic signal component from the combined and transformed signal, whereby breakpoints in the segmented transfer function are smoothed. The net result is an "apparent" transfer function that approximates the desired smooth transfer function with greater accuracy than the segmented transfer function itself.

In another aspect of the invention, a method is presented for producing a linearly varying signal from a signal having a nonlinearly varying portion. In accordance with the method, a signal having an a.c. component is added to the signal having a nonlinearly varying portion to produce a summation signal. The summation signal is then applied to a circuit having a piecewise linear segmented transfer function approximating a transfer function required to produce a linear representation of the signal having a logarithmically varying portion. The transformed signal is then applied to a filter which removes the previously added a.c. component to produce a smooth, linear output signal.

BRIEF DESCRIPTION OF THE DRAWING

The invention is illustrated in the accompanying drawing wherein.

DETAILED DESCRIPTION OF THE PREFERRED EMBODIMENT

Figure 1:
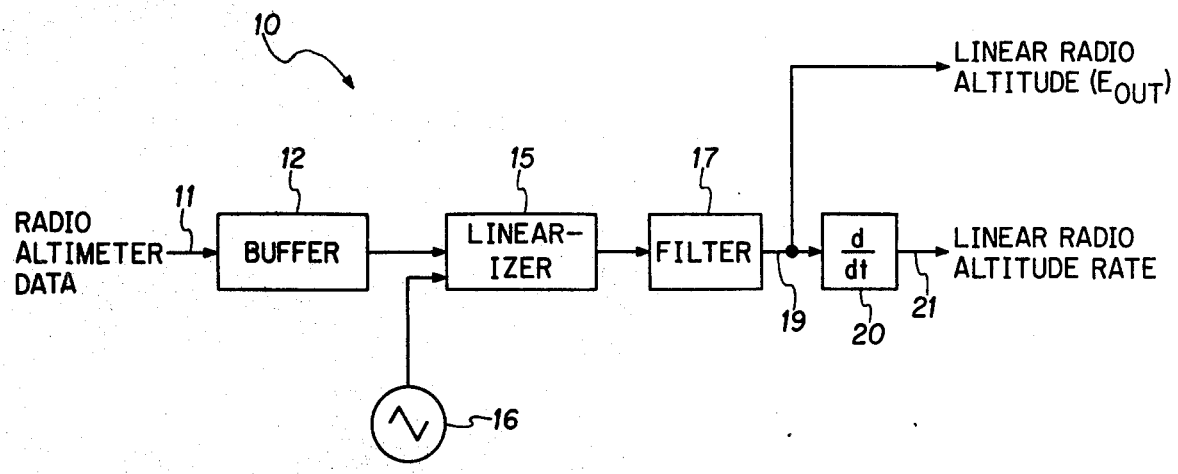
FIG. 1 is a box diagram of a portion of a radio altitude circuit for producing signals representing linear radio altitude and linear radio altitude rate from radio altimeter data having linear and logarithmically varying portions, utilizing the linearizing and smoothing apparatus in accordance with the invention.

A waveform linearizing circuit 10 employing the smoothing circuits of the invention is shown in block diagram form in FIG. 1, and is described with particular reference to a radio altimeter waveform linearizing or rescaling system. As shown, data from a standard radio altimeter conforming to ARINC specifications (i.e. having a linearly varying portion representing lower altitudes and a logarithmically varying portion representing higher altitudes) is applied on line 11 to a buffer 12. The output of the buffer is an analog representation of the radio altitude in feet and is described by these equations:

$$E_{IN} = -0.007(H_R + 20) \text{ for } H_R \leqq 480 \text{ feet and}$$

$$= -3.5(\ln e(H_R + 20)/500) \text{ for } H_R > 480 \text{ feet,}$$

where $H_R$ is the radio altitude in feet, and $E_{IN}$ is in volts. The output from the buffer 12 is applied to a linearizer circuit 15, which has a non-linear transfer function to produce in its usual operation a piecewise linear representation of the buffered radio altimeter data signal, in accordance with the formula $$I = 4.667 \times 10^{-5}(H_R + 20),$$

where $I$ is in amperes, and $H_R$ is in feet. Additionally, an a.c. signal or other periodic time varying signal generated by a.c. signal source 16 is applied to the input of the linearizer 15 and added to the buffered radio altimeter data signal.

The output from the linearizer 15 is then filtered in filter circuit 17 to produce an output 19 which is a rescaled, linear radio altitude representing signal. The output 19 is of a smooth character, as will become apparent below, and may be differentiated, if desired, by a differentiator circuit 20 to produce a linear radio altitude rate of change signal on line 21.

Figure 2:
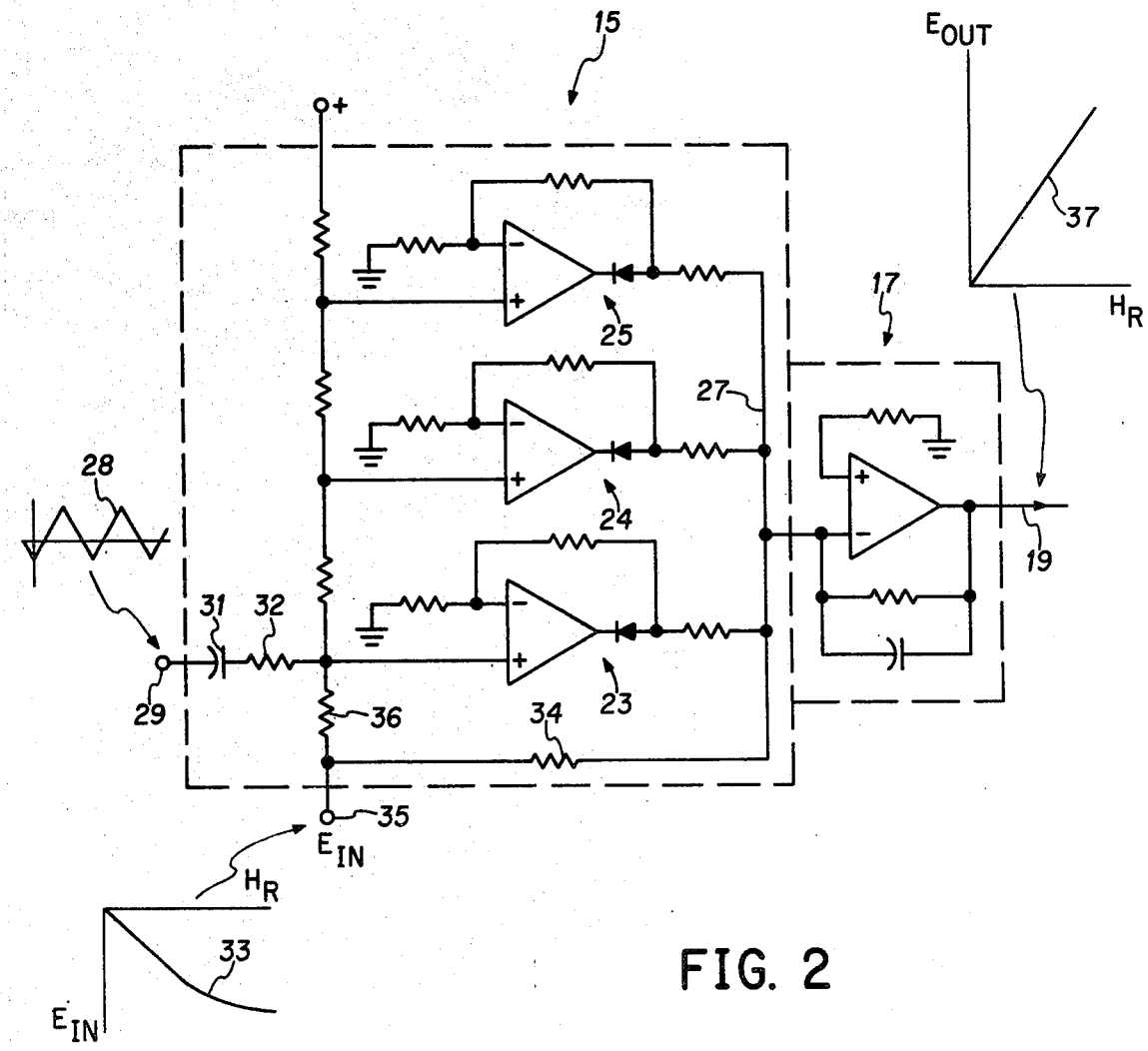
FIG. 2 is an electrical schematic diagram of the scale transforming and waveform smoothing circuit in accordance with the invention, used to linearize a signal having linear and logarithmic portion.

The schematic diagram of the linearizer circuit 15 of FIG. 1 is shown in detail in FIG. 2. As can be seen, the linearizer circuit 15 includes a plurality of operational amplifier circuits 23–25, each biased to operate over a respective range of input signals to produce at their common outputs 27 a piecewise linear signal. Such piecewise linear generating circuits and the biasing requirements therefor are well known in the art and are not described herein further in detail.

As shown, an a.c. signal, shown by the waveform 28, is applied to an input terminal 29 of the linearizer circuit 15, to be applied via a capacitor 31 and resistor 32, in series, to the noninverting inputs of the respective operational amplifiers of the operational amplifier circuits 23–25. It should be noted that although a triangular waveform 28 is shown, other periodic signals may be advantageously employed, such as a sinusoid, or the like, as may be conveniently available from the particular device with which the circuit of the invention is utilized.

Concurrently, the buffered radio altimeter data signal, represented by the waveform 33 is applied to an input terminal 35 and is also conducted to the noninverting input terminals of the operational amplifier circuits 23–25 via resistor 36, and to the common output 27 via a resistor 34. Thus, the buffered radio altimeter waveform 33 and the time varying periodic signal 28 are added and amplified by the appropriate operational amplifier circuits 23–25.

The outputs from the operational amplifiers 23–25 of the linearizer circuit 15 are developed at their common outputs 27, and filtered by a filter circuit 17 to produce at the output thereof a linear signal waveform, represented by the waveform 37, in accordance with the formula:

$$E_{OUT} = 0.0035(H_R + 20),$$

where $E_{OUT}$ is in volts and $H_R$ is in feet.

Figure 3:
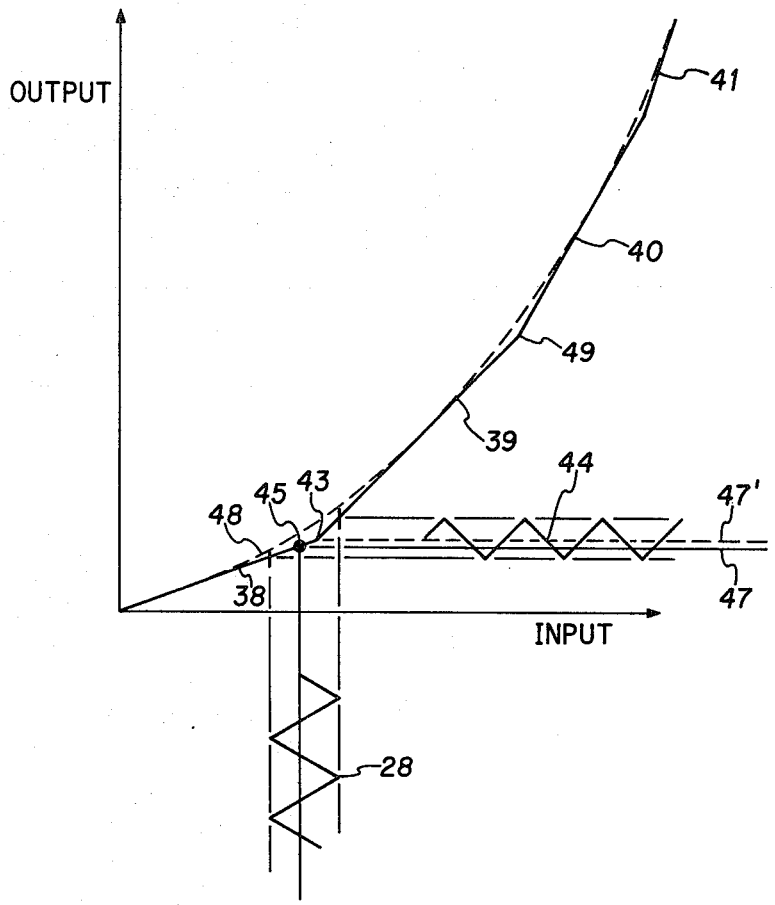
FIG. 3 is a graph of exaggerated scale of the input versus the output of the circuit of FIG. 2 showing the smoothing effects thereof.

More particularly, with reference now to FIG. 3, the respective outputs of the operational amplifier circuits 23–25 appearing at their common outputs 27 are represented by piecewise linear line segments 39–41. Thus, the operation of the circuit 15 is such that, for example, the voltage developed across the resistor 34 produces a first linear output segment 38. The operational amplifier circuit 23 is functional over a second predetermined region, and its output combines with that of resistor 34 to generate an output segment 39 corresponding to a first portion of the logarithmic region. Next, the second operational amplifier circuit 24 becomes effective to combine with the previous outputs to generate linear output segment 40 corresponding to another portion of the logarithmic region; and finally, the operational amplifier circuit 25 thereafter becomes operative to develop an output which, combined with the previous outputs, produces a linear segment output 41 corresponding to a further portion of the logarithmic region. Additional stages can be utilized to extend the region of the input curve over which the circuit is operative, or to increase its accuracy, if desired.

Graphically, as the output signal of the circuit 15 approaches, for example, the first breakpoint or discontinuity 43 between segments 38 and 39, the periodic time varying signal 28 applied to the input of the circuit 15 will begin to extend circuit operation across the breakpoint 43 and into the region of the segment 39. The output, therefore, seen at the output node 27 will be represented by a curve 44.

It can be seen that the normal output level without the superimposition of the periodic curve 28 at a Q point 45 beneath the breakpoint 43 will be a d.c. level 47. However, with the addition of the periodic waveform 28, the average d.c. value of the output will be raised as shown by the dotted line 47'. The excursions of the periodic time varying waveform 28 about Q point 45 and across the breakpoint 43 cause the amplifier 23 to conduct even though $E_{IN}$ is in the region below the breakpoint 43, thus producing the summation of the signals produced by resistor 34 and the operational amplifier circuit 23. Thus, after the output signal has been filtered by the filter circuit 17 to provide the average d.c. level, the output level for values of $E_{IN}$ near the breakpoint 43 will be higher than that which otherwise would have been obtained, and is shown by the dotted line 48 contrasted with the piecewise linear curve. The same action, of course, occurs at the second breakpoint 49 between the linear segments 39 and 40, and so on. The resulting output signal, therefore, is smooth along its entire length, enabling accurate differentiation thereof for an accurate determination of the rate of change thereof.

Figure 4:
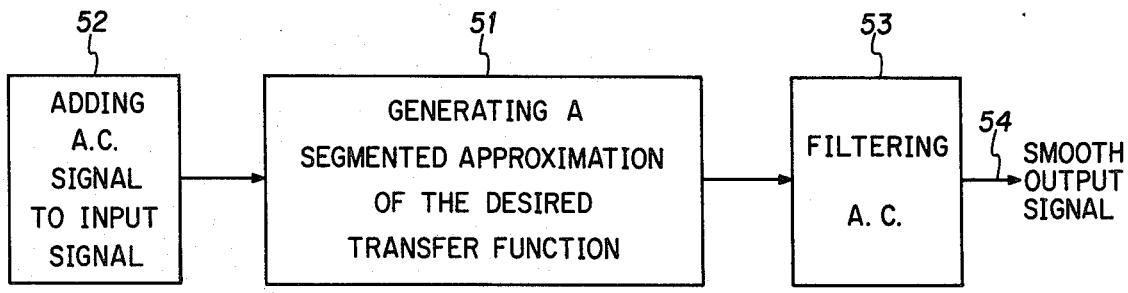
FIG. 4 is a box diagram showing broadly the steps of the method for smoothing a segmented signal waveform in accordance with the invention.

Therefore, in view of the above, it can be seen that the method by which the invention achieves a smoothing of a segmented signal, as shown in FIG. 4, includes the steps of generating a segmented approximation of the desired transfer function, box 51, adding an a.c. signal to the signal at the input of the transfer function circuit, box 52, then filtering the a.c. signal from the approximation, box 53, to produce a differentiatable smooth output signal 54.

It is apparent from the above that although the invention has been described with particular reference to linearizing or smoothing a radio altimeter data signal, the circuit can be equally advantageously employed to smooth any nonlinear signal, and, to produce a smoothly varying waveform across adjoining segments of segmented transfer functions to minimize the effect of the breakpoint therebetween, enabling, for instance, differentiation of the signal.

Although the invention has been described and illustrated with a certain degree of particularity, it is understood that the present disclosure has been made only by way of example and that numerous changes in the arrangement and combination of parts may be resorted to without departing from the spirit and scope of the invention as hereinafter claimed.

I claim:

1. A circuit for providing a transfer function which accurately approximates a desired smooth transfer function, comprising:

means for generating a periodic signal, means for combining the periodic signal with an input signal, means for transforming the combined input and periodic signals, said transforming means having a transfer function which is a segmented approximation of the desired smooth transfer function, and means for filtering the periodic signal from the combined and transformed signal, whereby an apparent transfer function approximating the desired smooth transfer function results.

2. A circuit for smoothly rescaling an input signal, comprising:

a plurality of amplifiers having inputs to which said input signal is applied, each amplifier being operative over a respective region of said input signal, a periodic signal generator, means for adding the periodic signal to said input signal at the inputs of said plurality of amplifiers, and means for filtering said periodic signal from said output signal, whereby a smoothed, rescaled signal of said input signal is generated.

3. The circuit of claim 2 wherein said input signal is a signal of a radio altimeter having linear and logarithmic portions, and wherein said rescaled signal is a linear signal.

4. The circuit of claim 3 further comprising means for differentiating said linear signal to produce a signal representing the rate of change thereof.

5. A circuit for modifying a signal in accordance with a smooth transfer function, comprising:

(a) a source providing a periodic signal, (b) means for adding said periodic signal to said signal to be modified to produce an input signal, (c) a circuit having a transfer function represented by a plurality of piecewise linear segments, having an input to which said input signal is applied to produce a transformed output signal, and (d) means for filtering said periodic signal from said transformed output.

6. The circuit of claim 5 wherein said circuit having a transfer function comprises a plurality of amplifiers, each operative over a respective region of said signal to be modified to generate a respective segment of said piecewise linear transfer function.

7. The circuit of claim 6 wherein said signal to be modified is an altitude signal conforming to ARINC specifications, and the transfer function of said amplifiers defines an inverse logarithmic function, whereby the filtered and transformed output is a linear signal.

8. The circuit of claim 7 further comprising means for differentiating said linear signal to produce a signal representing its rate of change.

9. A circuit for linearizing a signal having linear and logarithmically varying portions, comprising:

a plurality of operational amplifiers each having an input to which said signal to be linearized is applied, said operational amplifiers being biased to each produce a linear output segment over a predetermined range of said signal to be linearized, and having their outputs interconnected to produce a piecewise linear summation signal approximating said signal to be linearized, and means for biasing said operational amplifiers into conduction beyond their predetermined ranges to produce a smooth transition between adjacent ranges.

10. A method for producing a linearly varying signal from a signal having a nonlinearly varying portion, comprising:

adding a signal having an a.c. component to said signal having a nonlinearly varying portion to produce a summation signal, applying said summation signal to a circuit having a piecewise linear segmented transfer function approximating a transfer function required to produce a linear representation of said signal having a logarithmically varying portion, and filtering the a.c. component from said summation signal to produce the linear signal.

11. The process of claim 10 wherein said signal having a nonlinearly varying portion is a signal having a logarithmically varying portion.

12. The process of claim 11 further comprising the step of differentiating the filtered summation signal to produce a differentiated signal representing the rate of change thereof.

13. The process of claim 12 further comprising deriving said signal having a nonlinearly varying portion from an output of a radio altimeter, whereby the filtered summation signal represents linear altitude and the differentiated signal represents rate of change of altitude.

* * * * *